US009016503B2

(12) United States Patent
Barbier et al.

(10) Patent No.: US 9,016,503 B2
(45) Date of Patent: Apr. 28, 2015

(54) TAMPER-EVIDENT CONTAINER WITH MULTI-ACTION BREAKAWAY HINGE

(75) Inventors: Marco Barbier, Dover, MA (US); Lawrence Murdoch, Greenville, RI (US)

(73) Assignee: Easypak LLC, Leominster, MA (US)

( * ) Notice: Subject to any disclaimer, the term of this patent is extended or adjusted under 35 U.S.C. 154(b) by 598 days.

(21) Appl. No.: 13/348,038

(22) Filed: Jan. 11, 2012

(65) Prior Publication Data

US 2012/0181280 A1 Jul. 19, 2012

Related U.S. Application Data

(60) Provisional application No. 61/433,654, filed on Jan. 18, 2011, provisional application No. 61/487,801, filed on May 19, 2011.

(51) Int. Cl.

| | |
|---|---|
| ***B65D 41/32*** | (2006.01) |
| ***B65D 17/34*** | (2006.01) |
| ***B65D 6/28*** | (2006.01) |
| ***B65D 8/18*** | (2006.01) |
| ***B65D 39/00*** | (2006.01) |
| ***B65D 55/02*** | (2006.01) |
| ***B65D 43/02*** | (2006.01) |
| ***B65D 43/16*** | (2006.01) |

(52) U.S. Cl.

CPC ..... *B65D 55/024* (2013.01); *B65D 43/0235* (2013.01); *B65D 43/162* (2013.01)

(58) Field of Classification Search

CPC ..... B65D 43/02; B65D 43/0235; B65D 43/0237; B65D 43/0239; B65D 43/0241; B65D 43/0254; B65D 43/06; B65D 55/024; B65D 2543/00101; B65D 2543/00324; B65D 2543/00842; B65D 2543/00925; B65D 2101/0015; B65D 2101/0023; B65D 2101/0092; B65D 43/0258; B65D 43/162

USPC ..... 220/266, 270, 271, 4.23, 789, 791

See application file for complete search history.

(56) References Cited

U.S. PATENT DOCUMENTS

| | | | |
|---|---|---|---|
| 3,082,903 | A | 3/1963 | Stevens et al. |
| D327,220 | S | 6/1992 | Proffitt et al. |
| D332,917 | S | 2/1993 | McDevitt et al. |
| D354,436 | S | 1/1995 | Krupa |
| 5,897,011 | A | 4/1999 | Brilliant et al. |
| D409,484 | S | 5/1999 | Tasker |

(Continued)

FOREIGN PATENT DOCUMENTS

| | | | |
|---|---|---|---|
| CA | 2565664 | A1 | 1/2008 |
| GB | 2412651 | A | 10/2005 |

OTHER PUBLICATIONS

Par-Pak's Break AwayTamper-Visible Containers, Oct. 2010, www.parpak.com/breakaway.

*Primary Examiner* — Fenn Mathew
*Assistant Examiner* — Andrew T Kirsch
(74) *Attorney, Agent, or Firm* — Barlow, Josephs & Holmes, Ltd.

(57) ABSTRACT

A novel and unique container of a general clamshell configuration is provided. The hinge of the container of the present invention is particularly unique in that it not only provides a hinged connection between the lid and the base of the container for ease of use by the contents manufacturer during filling but is also breakable in different ways to provide a tamper-evident function without creating small parts that must be disposed of separately from the lid.

13 Claims, 23 Drawing Sheets

(56) References Cited

U.S. PATENT DOCUMENTS

| | | | | |
|---|---|---|---|---|
| 5,938,068 | A * | 8/1999 | Atkins et al. | 220/839 |
| D419,870 | S | 2/2000 | Albright et al. | |
| 6,554,147 | B1 * | 4/2003 | Maida et al. | 220/4.23 |
| D483,664 | S | 12/2003 | Cadiente | |
| 7,073,680 | B2 | 7/2006 | Boback et al. | |
| 7,118,003 | B2 | 10/2006 | Sellari et al. | |
| D558,045 | S | 12/2007 | Templeton | |
| 7,568,589 | B2 | 8/2009 | Vovan | |
| 7,712,626 | B2 | 5/2010 | Vovan | |
| 7,992,743 | B2 | 8/2011 | Vovan | |
| D645,737 | S | 9/2011 | Oakes | |
| 8,028,851 | B2 | 10/2011 | Vovan et al. | |
| 8,091,731 | B2 | 1/2012 | Kidd et al. | |
| D654,787 | S | 2/2012 | Kissner et al. | |
| 2008/0087669 | A2 | 4/2008 | Boback et al. | |
| 2009/0223966 | A1 | 9/2009 | Kidd et al. | |
| 2010/0102074 | A1 | 4/2010 | Parikh et al. | |
| 2011/0175261 | A1 | 7/2011 | Boback et al. | |

* cited by examiner

TAMPER-EVIDENT CONTAINER WITH MULTI-ACTION BREAKAWAY HINGE

CROSS-REFERENCE TO RELATED APPLICATION

This application is related to and claims priority from earlier filed provisional patent application Ser. No. 61/433,654, filed Jan. 18, 2011 and Ser. No. 61/487,801, filed May 19, 2011, the entire contents thereof is incorporated herein by reference.

BACKGROUND OF THE INVENTION

The invention relates generally to containers, such as those in the configuration of packages and tubs, which may or may not have a lid. Further, the present invention relates to such containers that are used to store articles, such as food.

It is well known in the art that containers are commonly used to store food, but it should be understood that the invention relates to any type of container for any type of purpose.

More specifically, the present invention relates to disposable food containers, which have particular application for containing food that is for sale, such as at a food market. These containers are commonly made out of disposable and recyclable materials, such as paper and plastic. As a result, there is a first concern as to the use of material that can be recycled. Also, there is a concern that the packaging container be clear or have a window so the consumer can inspect the food prior to purchase. In view of these needs, a container base is provided that houses the food with a lid secured thereto. Commonly the lid simply snaps to the base to seal the food contents therein. The lid can be a separate member or hingedly connected to the base. A container with a the lid hingedly connected to the base is commonly referred to as a "clamshell" container configuration.

In use, the food manufacturer or food preparer simply loads the food into the base and then snaps the lid thereon. When the consumer is ready to eat the food, they separate the lid from the base to gain access to the food residing in the base.

In addition to the concerns of recycling and ability to inspect the food in the container, there is also the serious concern of preventing tampering of the container, for purposed of intentional contamination or theft, that must be also be addressed. If tampering cannot be prevented, there is a desired to make it evident that the container has been tampered with. Various efforts have been made in the prior art to completely prevent tampering of a container but this can be very difficult. As a result, the industry has focused on containers that are "tamper-evident" where the container clearly indicates to the consumer that the container may have been tampered with and that they should not purchase that particularly container of food.

The simplest efforts in the prior art to make a container tamper-evident is to simply provide a sticker or label across the opening or seal between the base and the lid. However, this requires the food preparer to remember to add the sticker. Also, stickers or labels can be removed.

Further efforts in the prior art involve the use of buttons or other frangible or breakable members on the base and the lid that can secure the two to each other but upon breaking, cannot be resealed leaving the container in a condition that makes it clear to the consumer that the container has already been opened and should not be purchased.

For example, clamshell package designs are common in the prior art that include a lid that is hingedly connected to a base that contains the food product. The base includes an inner recessed peripheral top lip that receives the lid so that the peripheral edges of the lid are hidden making it very difficult to grip the edges of the lid for purposes of separating it from the base. A pull tab is present between the lid and the base. After the lid is secured to the base in hidden fashion, the pull tab is left remaining in view of the consumer to confirm that the container has not been tampered with. To gain access to the contents of the container, the consumer must completely remove the pull tab, which is held in place by perforations or slits. Complete removal of the pull tab leaves a flange remaining that makes it clear that the container integrity has been compromised. Such complete removal of the pull tab leaves flanges on the base and lid for the consumer to grasp to help them separate the lid from the base. A major drawback of this prior art container is the requirement to completely remove a element from the container, which results in an extra article of trash that must be disposed of by the consumer.

In another example, prior art containers are also well known to include a plastic lid that is heat sealed or welded to a plastic base that contains the food. An adhesive member, such as reinforced tape, is provided on the surface of a flange of a lid or base between the weld and the inside of the container. Perforation(s) or slit(s) are provided proximal to the tape. The tape assists in breaking the plastic, which is already weakened by the perforation(s) or slit(s). The tape is commonly colored to bring attention to it as a tamper-evident indicator. As in the above example, this separate member is completely removed from the container. When such a portion of the container is completely removed, it is readily apparent that the colored tape has been removed to show that the container has been tampered with. However, a separate portion of the container must now be removed and disposed of as trash.

There is also a need in the food industry to provide a breathable container that is suitable for storing vegetables, particularly leafy vegetables, such as lettuce. This is typically accomplished by holes in the container housing. There is a need in the art to provide a tamper-evident container that also provides breathability yet also includes a barrier to prevent liquids from entering into the container via the holes in the container body.

In view of the above, the prior art attempts in the prior art are not adequate as they result in additional articles of trash that must be disposed of. There is a need for a container that is tamper-evident yet does not necessitate the complete removal of a portion of the container. There is further demand for a tamper-evident container that is less expensive and complicated to manufacture than prior art containers. There is yet another need to provide a tamper-evidence container that is also breathable yet resists liquids from entering the container.

BRIEF SUMMARY OF THE INVENTION

The present invention preserves the advantages of prior art tamper-evident containers. In addition, it provides new advantages not found in currently available tamper-evident containers and overcomes many disadvantages of such currently available tamper-evident containers.

The invention is generally directed to the novel and unique container that has a general clamshell configuration. The hinge of the container of the present invention is unique in that it not only provides a hinged connection between the lid and the base of the container for ease of use by the food manufacturer during filling but is also breakable in different ways to provide a tamper-evident function without requiring a pull tab or pull strip from being completely removed from the container. To accomplish this, the hinge is specially configured to preferably be of a T-shape whereby the user can push down, push in, squeeze from top and bottom or pull up to effectuate breakaway of the hinge from the base while leaving the hinge connected to the lid.

It is therefore an object of the present invention to provide a tamper-evident container that is easy to fill with food.

Another object of the present invention is to provide a tamper-evident container that can be manufactured using common thermoforming equipment.

A further object of the present invention is to provide a tamper-evident container that clearly shows whether or not it has been tampered with if it has not been opened.

Another object of the present invention is to provide a tamper-evident container that clearly shows that it has been tampered with if it has been opened.

Yet another object of the present invention is to provide a tamper-evident container that provides a structure to facilitate separation of the lid from the base after the unique hinge construction has been broken.

Another object of the present invention is to provide a tamper-evident container that does not generate a separate pull tab or pull strip when the tamper-evident feature of the container is activated.

Yet another object of the present invention is to provide a tamper-evident container that can be opened in many different ways by using a multi-action breakaway hinge.

Another object of the present invention is to provide a container with a multi-action breakaway hinge that permits the container to breathe to not damage the food therein.

Another object is to provide a multi-action breakaway hinge that also prevents liquids from entering the container despite it being breathable.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE INVENTION

The hinge of the tamper-evident container of the present invention is unique in that it is of a breakaway configuration without requiring a pull tab or pull strip from being completely removed from the container. The hinge is a true hinge and remains connected to the lid even after the user manipulates it. This avoids less pieces of waste, particularly a small piece of waste, for disposal. Most notably, the hinge can be broken away in many different ways, as will be discussed below.

Figure 1:
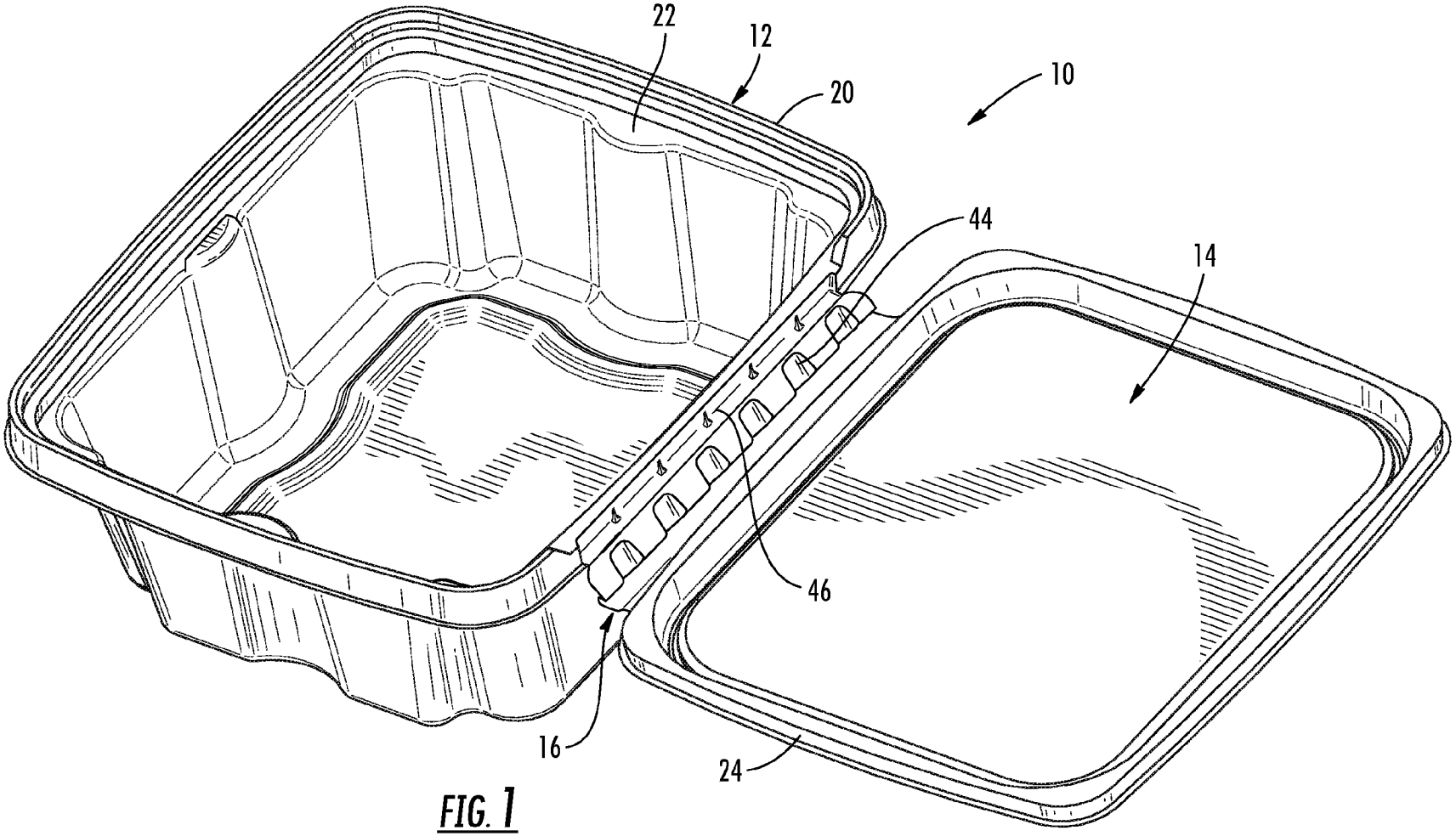
FIG. 1 is a top perspective view of the container of the present invention in an open condition prior to loading the container with the contents to be stored.
Figure 2:
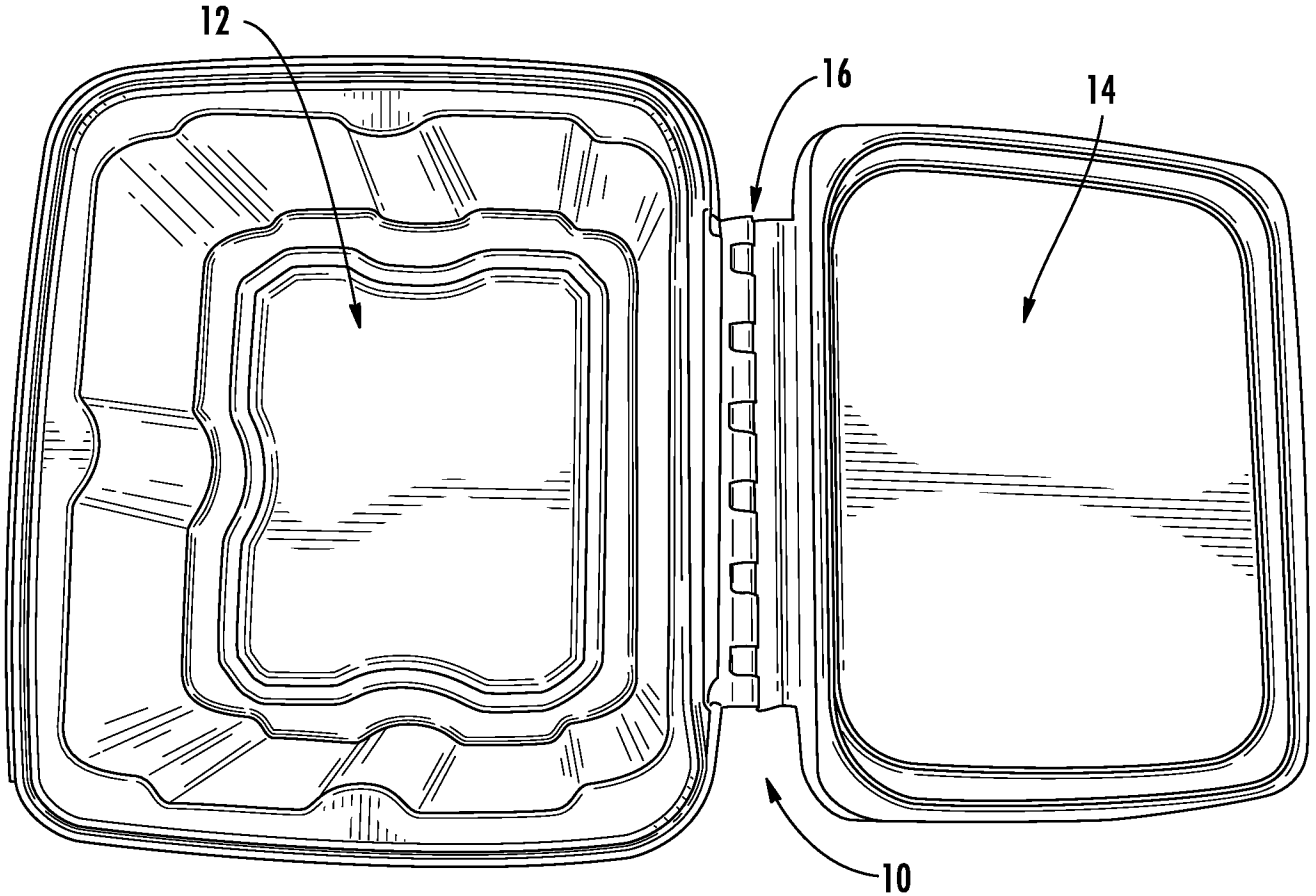
FIG. 2 is a top view of the container of FIG. 1 in an open condition prior to loading of the container with contents to be stored.
Figure 5:
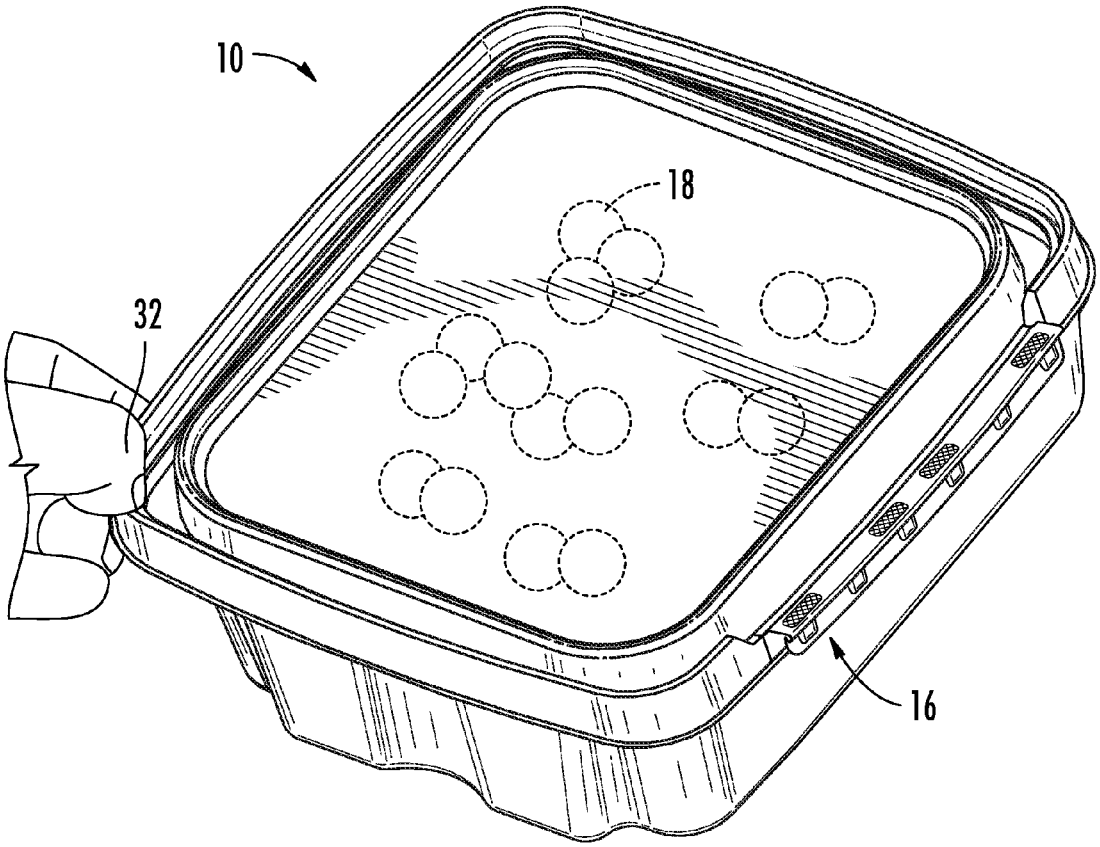
FIG. 5 is a perspective view of the container of FIG. 1 with lid being snapped closed to secure it to the base with hinge intact.
Figure 6:
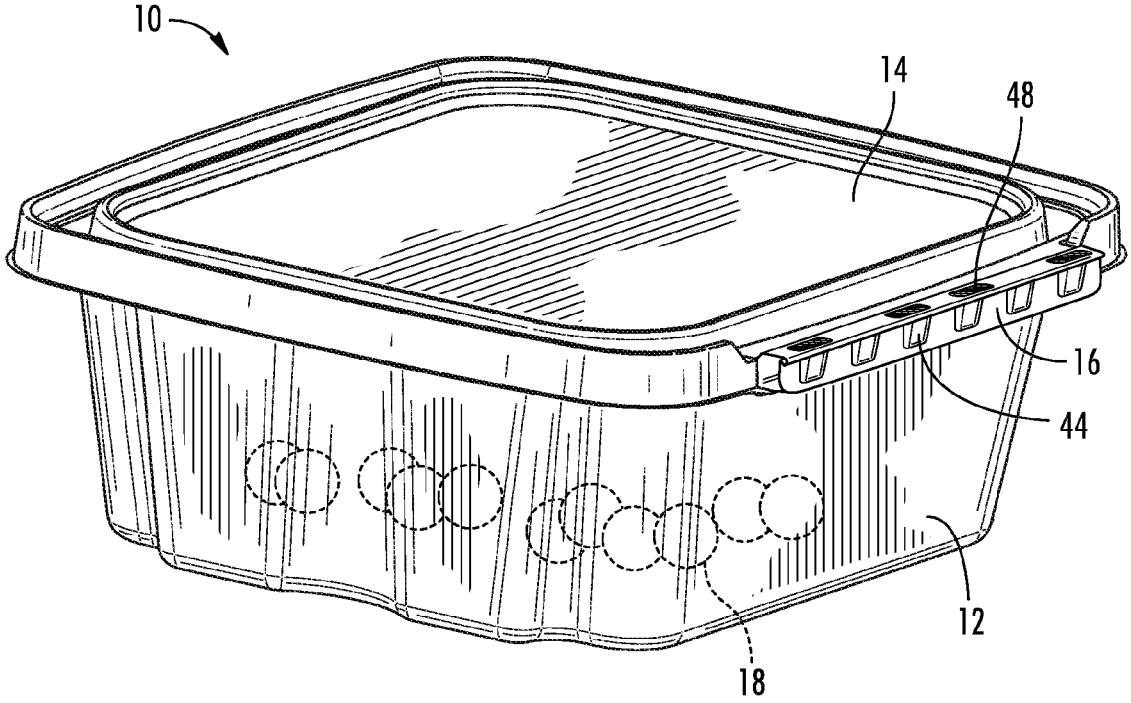
FIG. 6 is a front perspective view of the container of the present invention.
Figure 7:
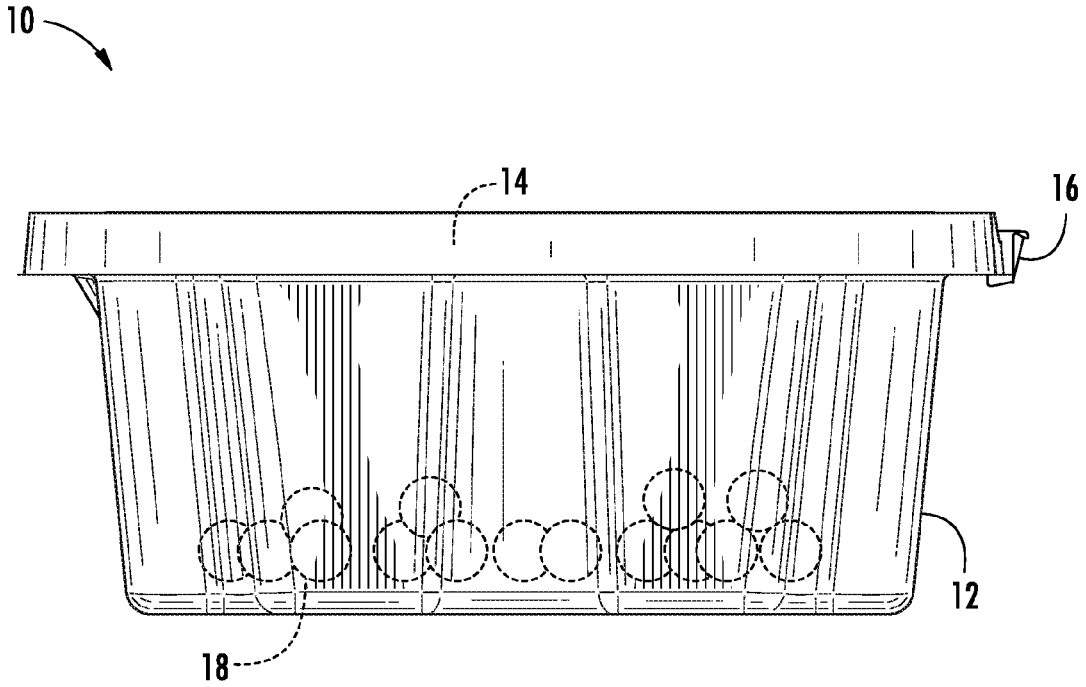
FIG. 7 is a left side elevational view of the container of FIG. 1; the right side elevational view being a mirror image thereof.
Figure 8:
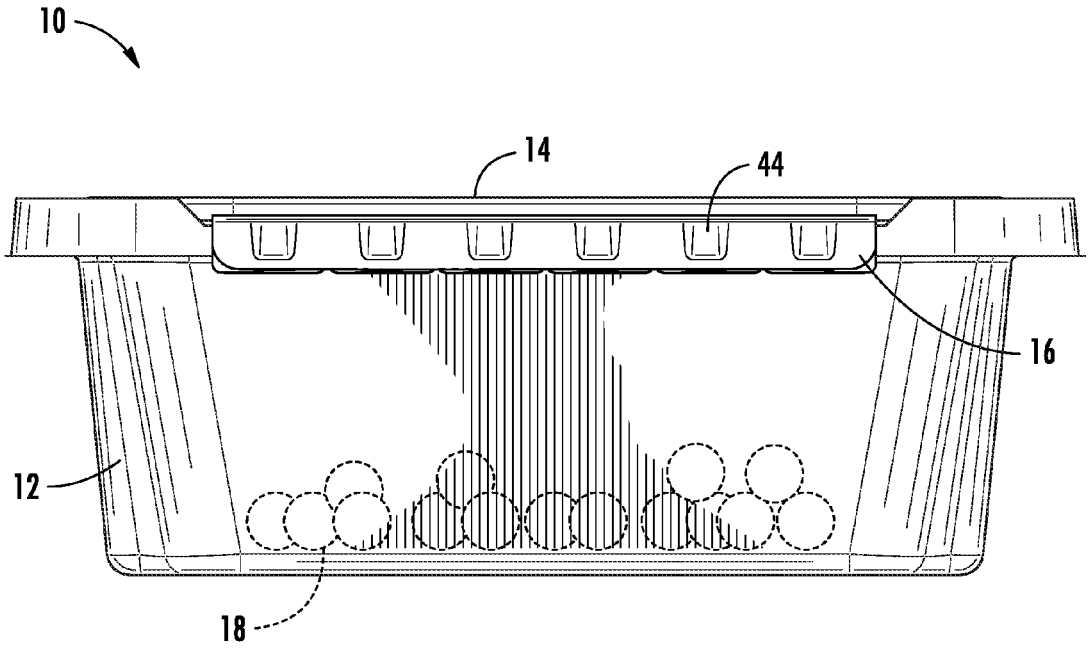
FIG. 8 is a front elevational view of the container of FIG. 1.

Turning first to FIG. 1, the tamper-evident container 10 of the present invention is shown to be of a general clamshell configuration with a base 12 and a lid 14 hingedly connected thereto via a multi-action breakaway reinforced hinge 16. A top plan view of the container 10 is shown in FIG. 2. Details of the unique hinge construction 16 will be discussed in detail below. For ease of discussion the container 10 is shown in FIG. 1 is an open condition prior to the securing it shut with contents, such as food, therein. Sample contents 18 are shown in FIGS. 6-8. The base 12 includes a top edge 20 with a peripheral bead or flange 22. As will be shown in FIGS. 4 and 5, the peripheral edge 24 of the lid snaps into the top edge 20 of the base 12 and secured by the peripheral bead or flange 22 to thereby hide the peripheral edge 24 of the lid 14. Such a hidden edge configuration is well known in the art. Such snapping of the top edge 24 into the base 12 under flange 22 can be easily carried out by hand without the needs for tools or machinery.

Figure 3:
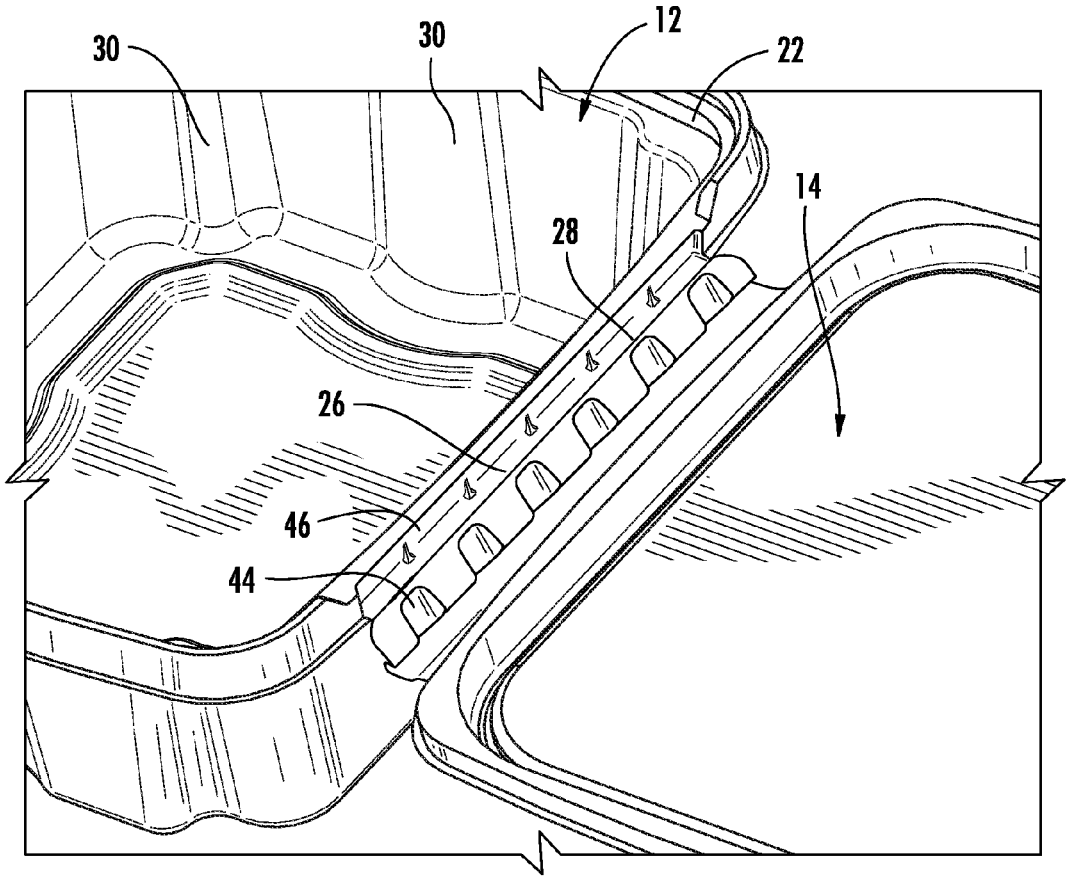
FIG. 3 is a close-up perspective view of the hinge of the container of FIG. 1.

A close-up view of the tamper-evident container 10 of the present invention and the unique hinge construction is shown in FIG. 3. As can be understood, the appropriate plastic of the desired mil thickness is provided, which is typically clear or translucent. A sheet of plastic is placed into tool and then formed as a unitary body, as best seen in FIG. 2, with the lid connected to the base. A new and unique hinge member is connected to the lid 14 and to the base 12. A hinge 16 is preferably permanently connected to the lid 14 but removably connected to the base 12. For example, the material used is preferably 0.025 inch Ga. PETE plastic. To carry out the removable connection of the hinge 16 to the base 12, a number of 0.5 mm nicks or perforations 26 in the plastic material are provided along the desired breakaway line 28 between the hinge 16 and the base 12. No such nick or perforations 26 are provided between the hinge 16 and the lid 14 as the hinge 16 remains connected to the lid 14 at all times.

Reinforcing columns or ribs 30 are formed in the base 12 for rigidity of the entire container 10. Such columns 30 may be provided of any desirable size and shape to make the side panels of the container 10 more rigid without increasing the thickness of the material used.

Figure 4:
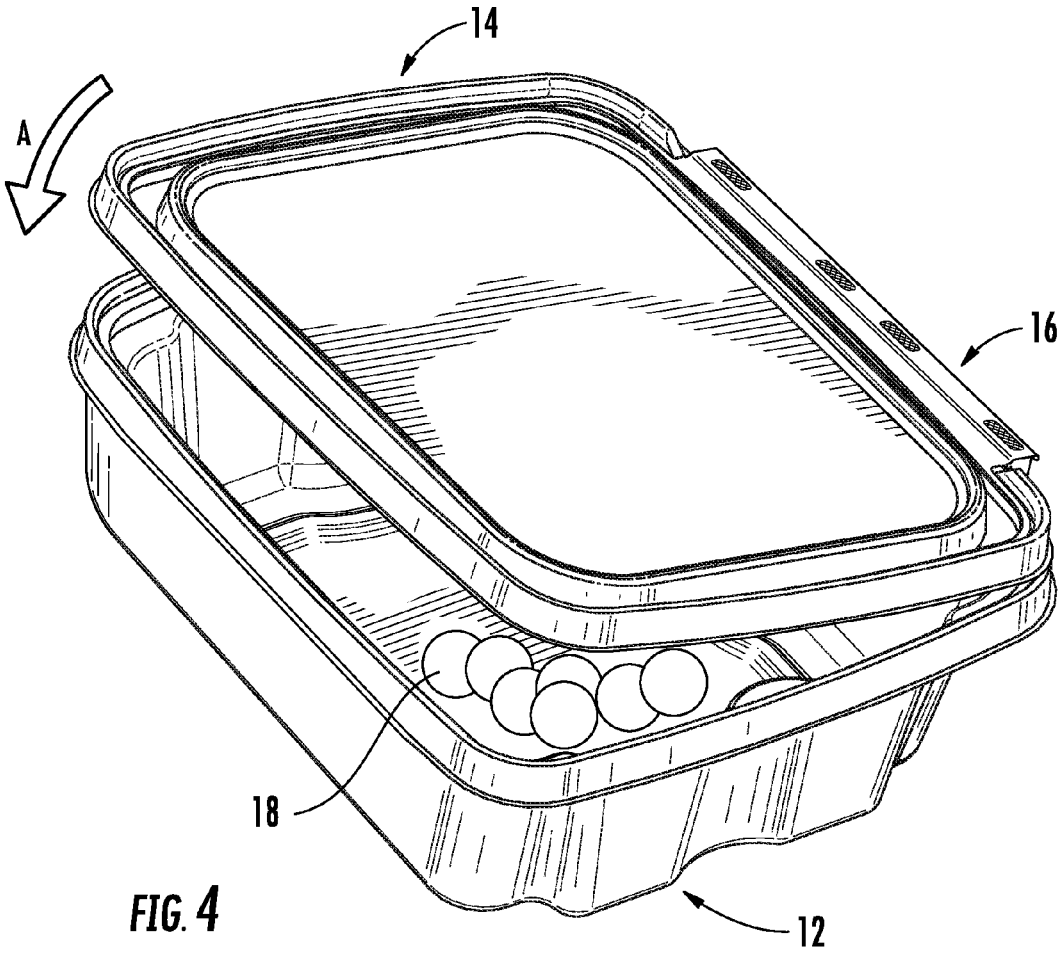
FIG. 4 is a perspective view of the container of FIG. 1 in the process of being closed to secure contents therein.

Next, as seen in FIG. 4, the food or other contents 18 to be stored in the container 10 of the present invention is loaded into the base 12 of the tamper-evident container 10 of the present invention and the lid 14 is pivoted about the hinge 16 in the direction of arrow A so that the lid 14 is sitting over the base 12 with the periphery 24 of the lid 14 aligned with the flange 22 of the top edge 20 of the base 12. In FIG. 5, the edge 24 of the lid 14 is snapped into place under the bead or flange 22 at the top edge 20 of the base 12 to hide the peripheral edge 24 of the lid 14. This can be carried out by simply pressing downwardly with the user's thumb or other finger 32 to urge the peripheral edge 24 of the lid 14 into the desired place. Now, the contents 18 are secured within the container 10. With the peripheral edge 24 of the lid 14 hidden, as is well known in the art, it is very difficult for a person to open the container 10 by manipulating the peripheral edge 24 of the lid 14 because of such hidden condition.

The container 10, with contents 18 safely stored therein, can now be shipped and/or placed on display for sale. During this loading, shipping and display condition of the container 10, the hinge 16 remains intact to maintain the lid 14 connected to the base 12. FIG. 6 shows a front perspective view of the container 10 with lid 14 engaged to the base 12 with contents 18, such as food, contained therein. FIGS. 7 and 8 show respective left and front elevational views thereof to clearly illustrate that the hinge 16 of the present invention remains intact during this storage and display condition of the container 10.

Although not shown, it is possible to include some type of additional structure on the container 10 to better help secure the lid 14 to the base 12 to supplement the engagement of the peripheral edge 24 of the lid 14 to the peripheral flange 22 of the base 12. A structure may be provided (not shown) that engages with another structure (not shown) on the base 12 to secure them together. For example, a structure on a free end of the lid 14 may interact with a corresponding structure on the base 12 to removably engage with each other. These structures may take any form or configuration to achieve such supplemental securing of the lid 14 to the base 12.

Figure 9:
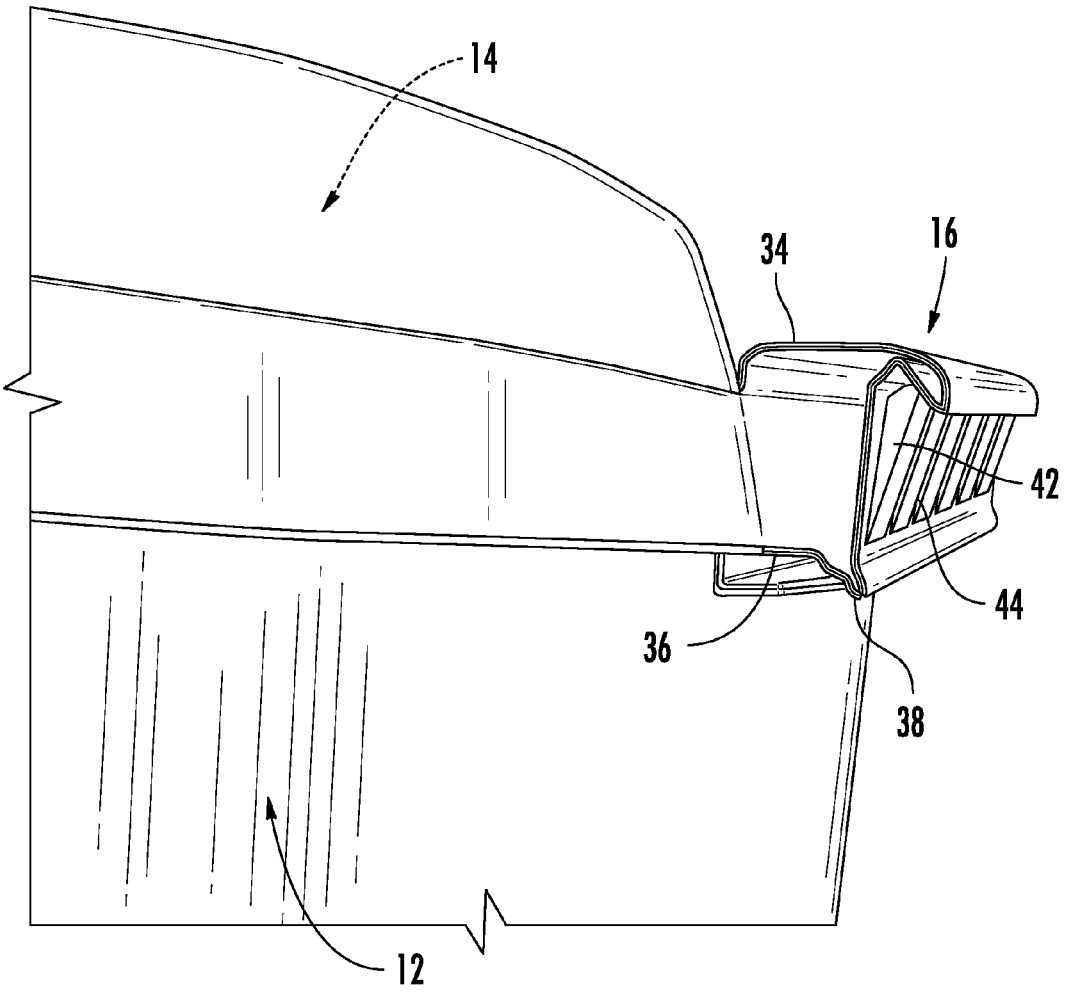
FIG. 9 is a close up side view of the hinge used in the container of FIG. 1.

Referring now to FIG. 9, the profile of the unique hinge construction 16 of the tamper-evident container 10 of the present invention is shown in detail. As can be seen, the hinge 16 is preferably permanently connected at its top portion 34 to the lid 14 and extends laterally to the right and then doubles back to form a simulated "T" and then down where it extends to a lower right corner where it is connected to a flange 36 emanating outwardly from the top edge 20 of the base 12. The "T" shape of the hinge 16 helps exert forces against the breakaway shear edge 38 to cause the lid 14 to separate from the base 12. The connection of the hinge 16, at its lower right corner at 38 to the flange 36 of the base 12, is preferably weakened by one or more "nicks" 40 (or perforations, slits, slots or any other structure) that weakens the connection of the hinge 16 to the flange 36 on the base 12 as mentioned above. These nicks 40 can be adjusted in number, size, depth, strength, etc. to control the amount of force that is required to shear the edge 38. In other words, the configuration of the nicks 40 can be easily adjusted to define the bonding strength of the lid 14 to the base 12 and how much force is required for the user to be able to detach the connected lid 14 and hinge 16 from the base 12.

The angles and relative dimensions seen in the figures are merely preferred for optimally carrying out the present invention, however, these are merely examples and other configurations may be employed.

Still referring to FIG. 9, the angles between the top portion 34, the vertical portion 42 and the bottom portion or base flange 36 can be approximately 90 degrees, as defined by the "T" or can be less or more of any angle. For example, these angles can be customized to promote one type of breaking (squeezing, pulling, pushing). For example, a 90 degree angle, such as seen in FIG. 9, promotes a squeezing operation although other types of breaking may be achieved.

This is very important to achieve the performance of the breakaway hinge 16 of the present invention. This angle plus the reinforcing ridges 44 makes the rupture of the hinge 16 easy and workable.

Figure 10:
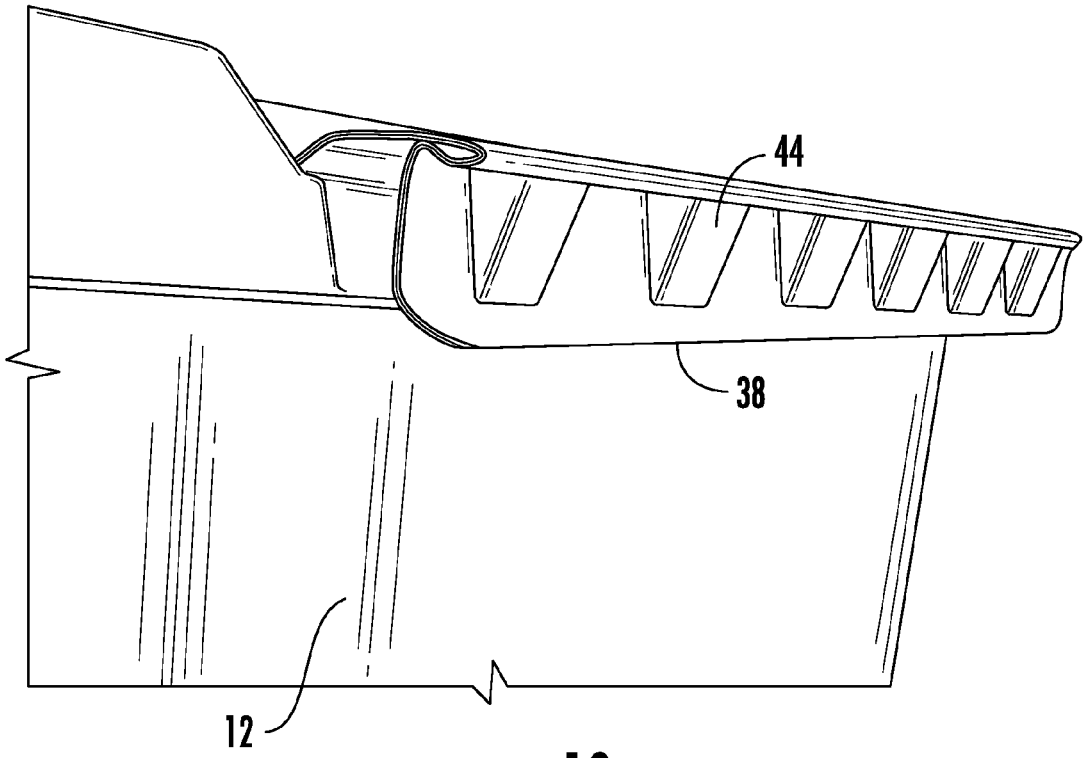
FIG. 10 is a close-up side perspective view of the hinge of the container of FIG. 1.
Figure 19:
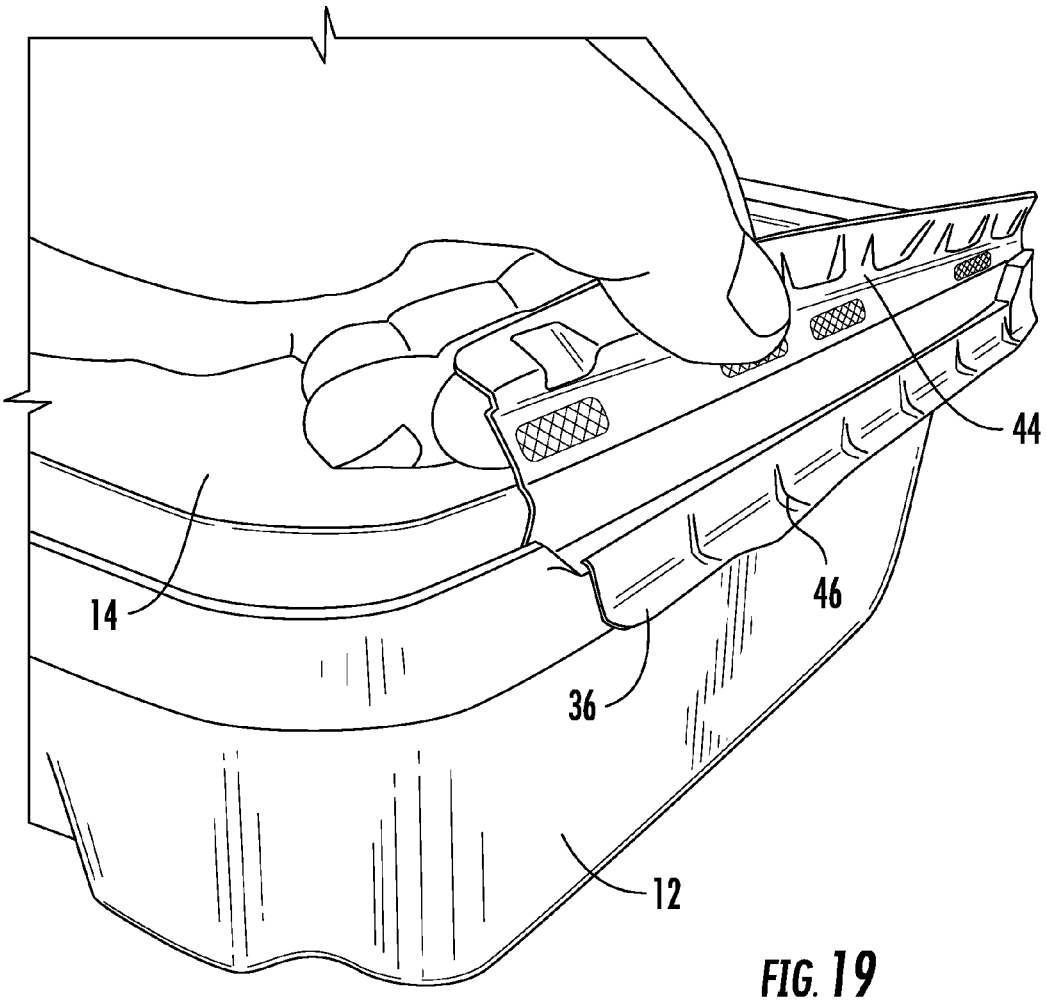
FIG. 19 is a perspective view of the container of FIG. 1 after the hinge has been manipulated and hinge broken away with the lid in the process of being pulled away from the base.

It should be noted that this configuration is preferred and that it is possible that the arrangement can be reversed wherein the connection of the hinge 16 to the lid is weakened by nicks 40, perforations, slits or the like. A perspective view of a preferred embodiment of the present invention where the weakened interconnection between the hinge 16 and the flange 36 of the base 12 can be seen in FIG. 10. Also, FIG. 10 shows the additional vertical reinforcing columns 44 on the vertical portion 42 of the hinge 16. Such reinforcement 44 is important to avoid having to use thicker plastic for the container 10, as are the reinforcing members 46 on the bottom flange portion 36 of the base 12 (as best seen in FIG. 19), during the process of actually breaking and shearing the hinge 16, as will be described below. The reinforcing members 44 and 46 help the various portions of the hinge 16 and base 12 maintain their shape during breaking action so that the desired action can be effectively achieved.

Figure 11:
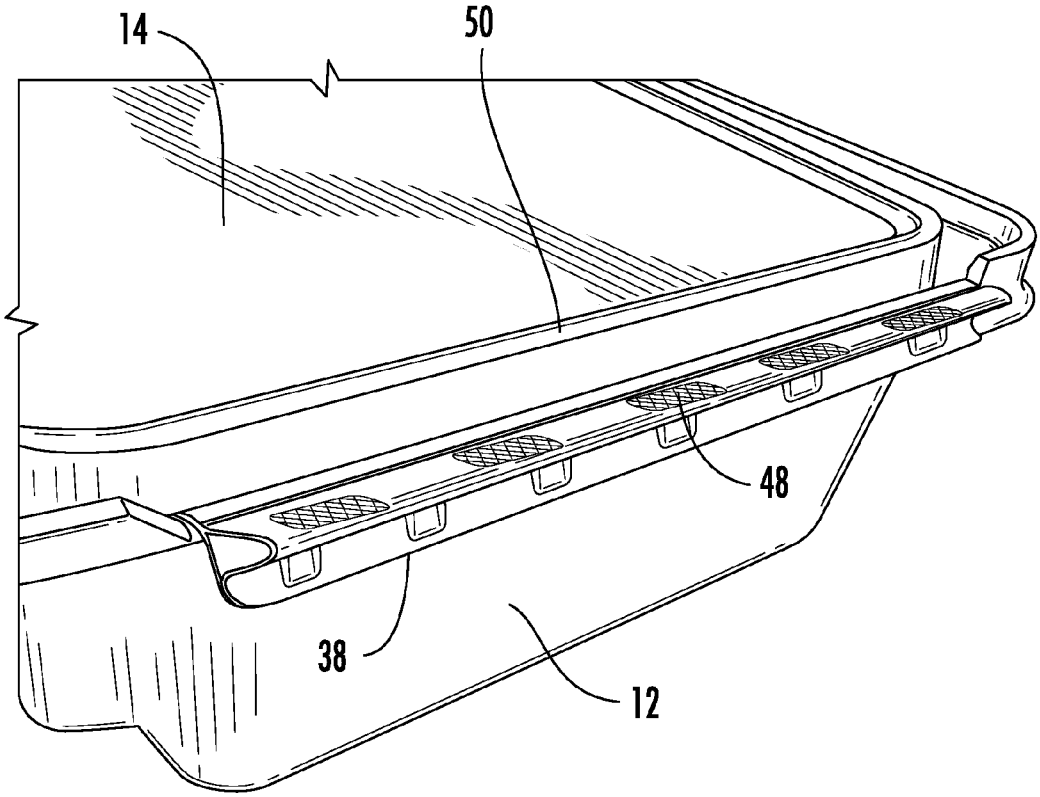
FIG. 11 is a close-up front perspective view of the hinge of the container of FIG. 1.

Once the lid 14 is closed and secured to the top of the base 12 with the contents 18 inside, it cannot easily be opened. At this point, the container 10 can be shipped, displayed for sale, exposed to the public, and the like. When the consumer is ready to access the contents 18 of the container 10, they are presented with the multi-action hinge 16, as seen in FIG. 11, in preparation for breaking to gain access the contents 18 in the container 10. This encourages the consumer/user to open the container 10 in this fashion rather than attempt to pry the peripheral edge 24 of the lid 14 from the flange 22 of the base 12. It is highly desired that the user open the container 10 by breaking away the hinge 16 because this provides the desirable tamper-evident features of the present invention. A series of gripping treads 48, as seen in FIG. 11, are preferably provided on the top surface of the hinge 16 to give additional grip and leverage for the consumer when squeezing or pressing downwardly, etc.

A unique aspect of the hinge configuration and profile of the present invention is the ability to break away the hinge 16 in multiple different ways. For example, instructions 50 can be placed on the top of the lid 14 that asks the user to "squeeze bar to break seal". Other signage may be provided to encourage a different type of breaking depending on the configuration of the container 10. The same hinge 16 may be pushed in different directions or pulled to achieve the same result of breaking the hinge 16 to separate the lid 14 from the base 12. The same T-shaped hinge 16 is well suited to achieve any of the aforementioned methods of breaking of the hinge 16 from the base 12.

Figure 12:
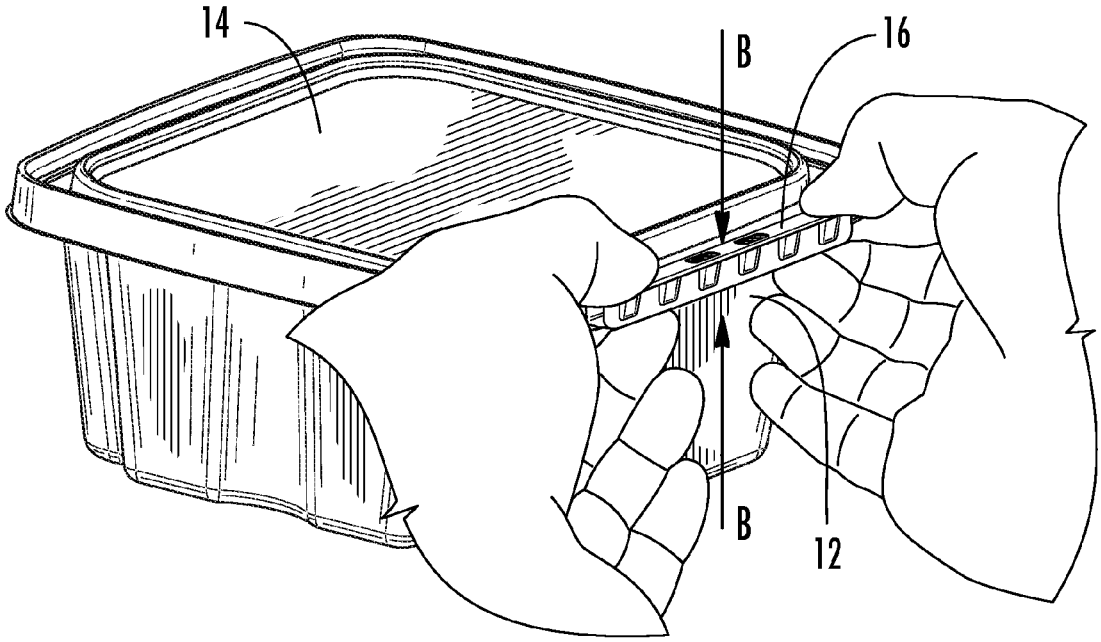
FIG. 12 is a front view of a closed container of FIG. 1 showing the hinge being manipulated by a user by squeezing from top and bottom.
Figure 13:
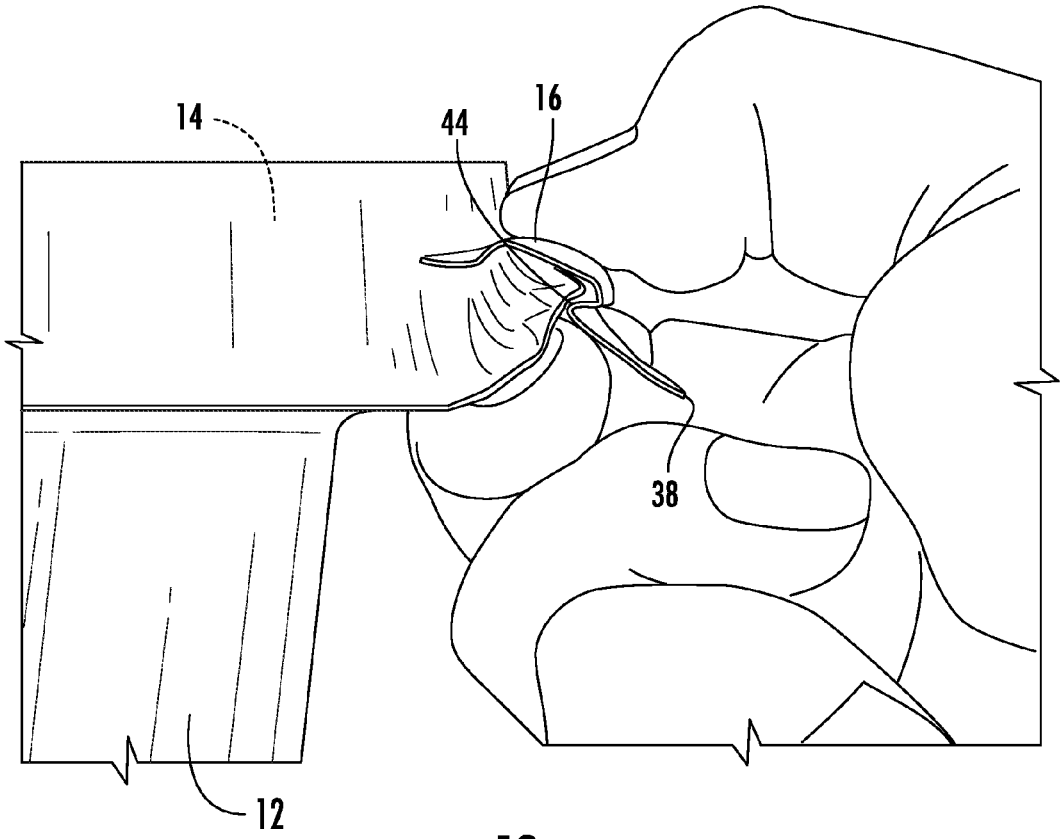
FIG. 13 is a side view of the manipulation of the hinge shown in FIG. 12 to cause breakaway of the hinge.

In FIG. 12, the hinge 16 is shown in the process of being broken by squeezing in the direction of arrows B by imparting downward and upward forces at the same time. FIG. 13 shows a side view of the result of such squeezing operation to break the break away the hinge 16. If enough force is provided by the user to overcome the tuned bonding strength of the plastic and nicks 40 connection, then the bottom edge 38 of the hinge 19 will break away, as seen in FIG. 13. During this breaking, the vertical reinforcements 44 on the hinge and the reinforcements 46 on the base 12 facilitate breaking by making the opposing structures of the base 12 and the hinge 16 more rigid.

Figure 14:
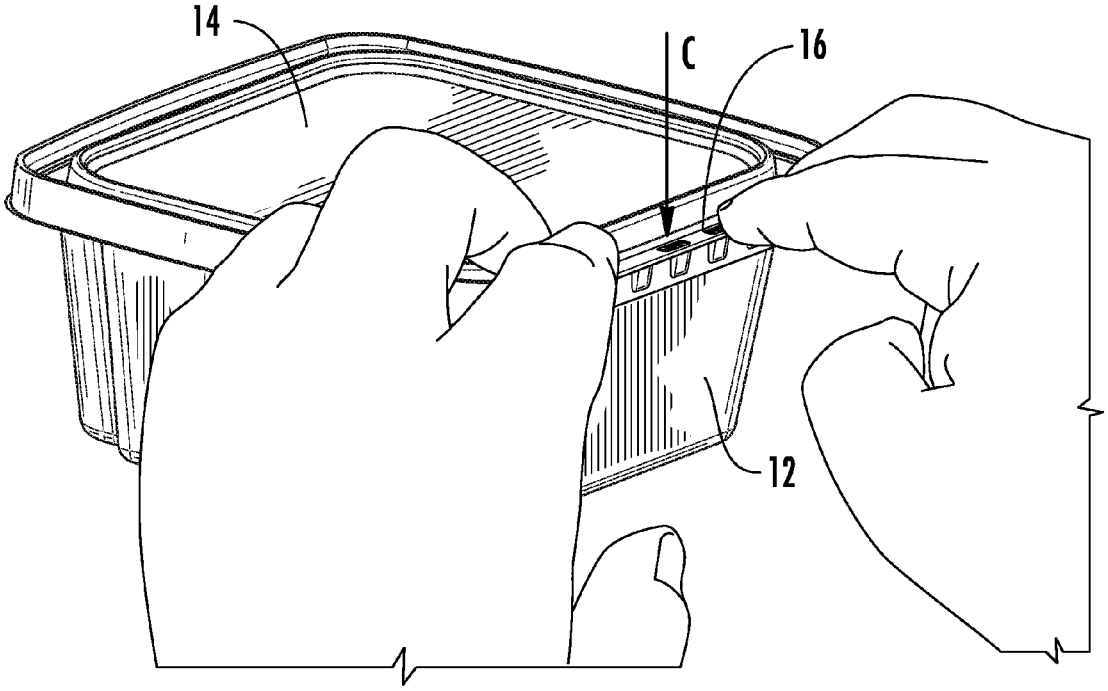
FIG. 14 is a front view of a closed container of FIG. 1 showing the hinge being manipulated by a user by pushing down from above.

In FIG. 14, the hinge 16 can be pushed down from the top to break the hinge 16 in the direction shown by the arrow C. As above, when the bonding strength of the plastic and nicks 40 interconnection is overcome, the hinge 16 can be broken away from the base 12. In this case, the vertical 44 and lateral reinforcements 46 are particularly useful to make the base 12 and hinge 16 more rigid during breaking.

Figure 15:
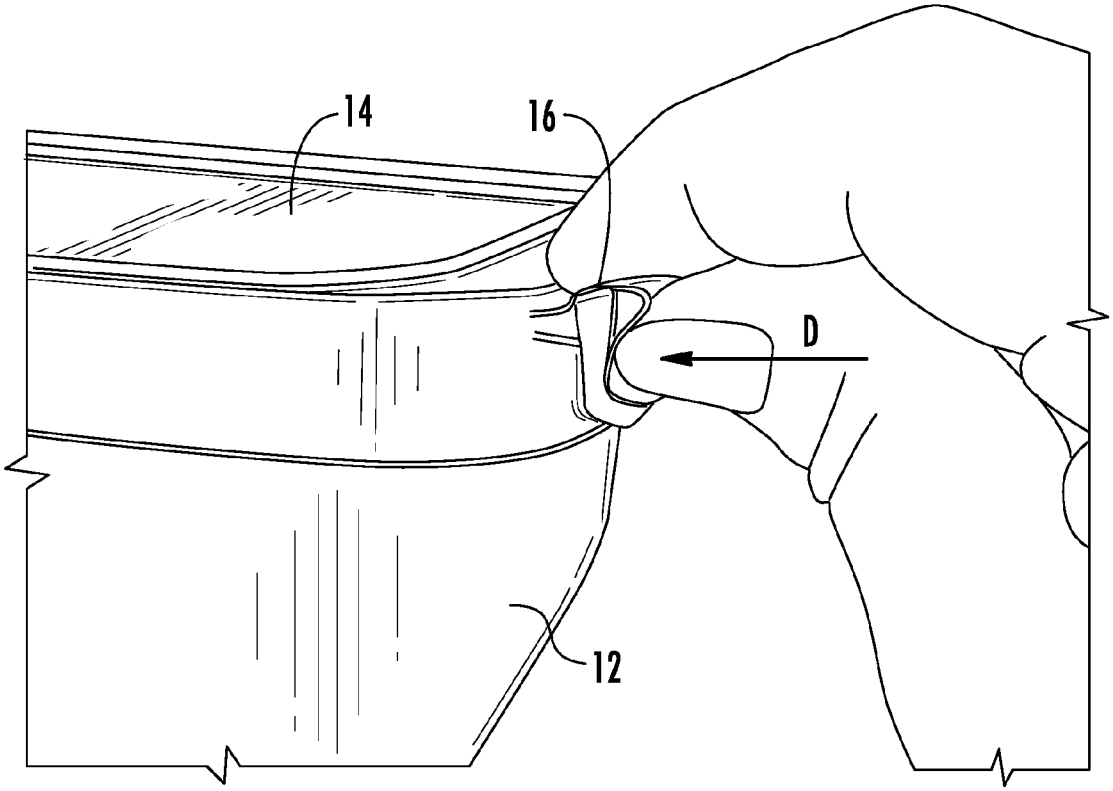
FIG. 15 is a side view of a closed container of FIG. 1 showing the hinge being manipulated by a user by laterally pushing in from the side.

Also, FIG. 15 shows yet another way that the hinge 16 can be broken away from the base 12. In this case, the hinge 16 may be pushed laterally from the side in the direction of arrow D. In this case, the lateral reinforcements 46 on the base 12 are particularly important so that breaking can be achieved.

Figure 16:
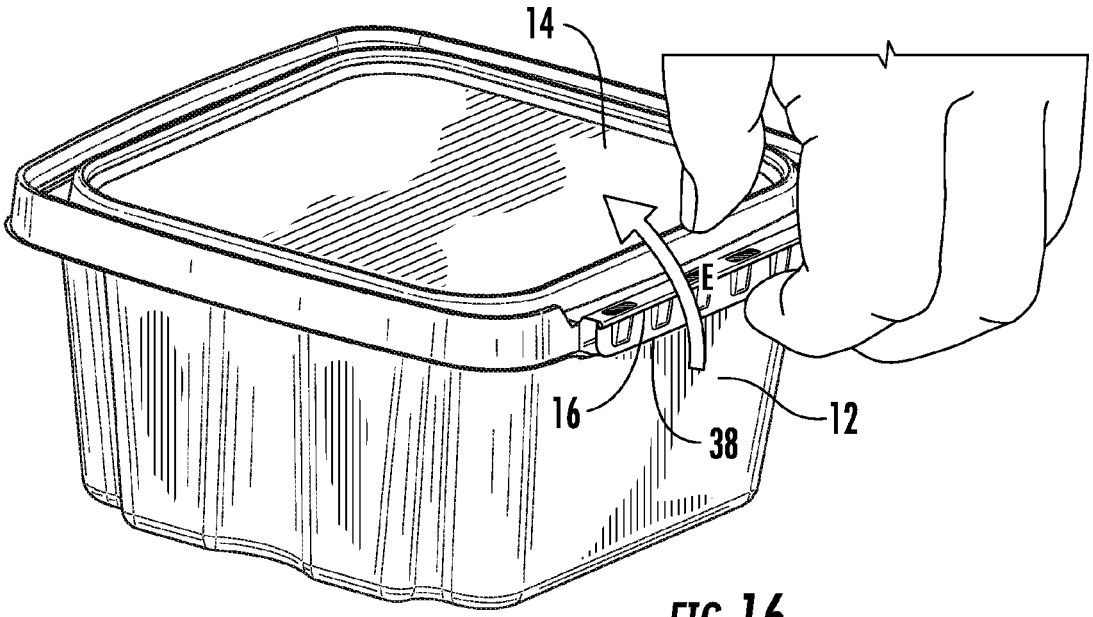
FIG. 16 is a side view of a closed container of FIG. 1 showing the hinge being manipulated by a user by pulling up from below.
Figure 17:
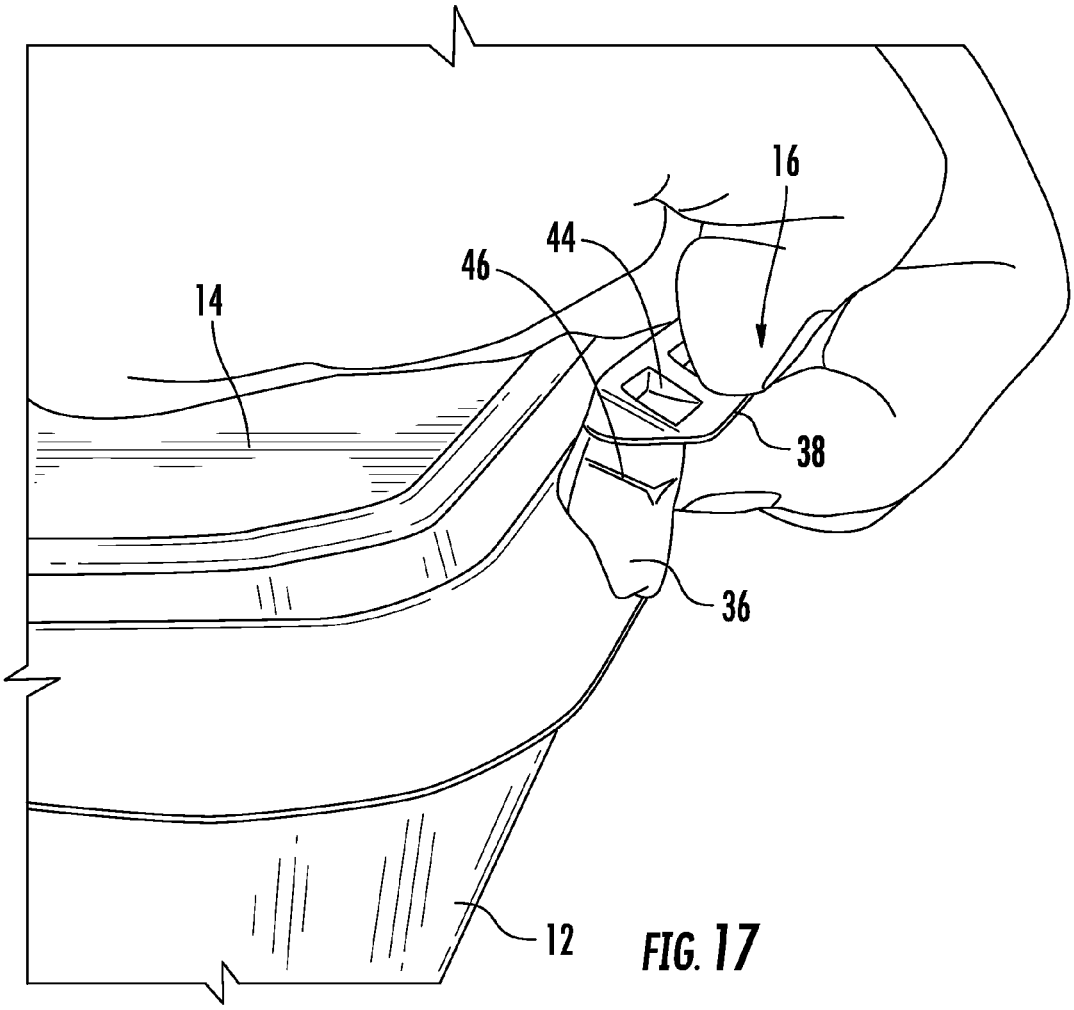
FIG. 17 is a side view of the manipulation of the hinge shown in FIG. 16 to cause breakaway of the hinge.

Still further, the hinge 16 may be broken away by a pulling from the bottom of the hinge in the direction of arrow E, as seen in FIGS. 16 and 17. In this case, the user grips the bottom edge 38 of the hinge 16 and pulls upward. In this case, the vertical reinforcements 44 on the hinge 16 are particularly important so that the hinge 16 is as rigid as possible during the pulling operation to break away the hinge 16 and lid 14 from the base. FIG. 17 illustrates this wherein such pulling results in the user grasping the hinge 16 during the breaking process.

Therefore, it can be seen that the unique profile and configuration of the hinge 16 of the present invention enables the hinge 16 to be broken in many different ways. This is helpful when the user may not precisely follow the directions on the top of the container 10 for opening the container 10 and breaking the hinge 16 to, effectively, break the seal of the overall container 10. It can be seen that by simply squeezing, pushing downwardly, horizontally or pulling on the hinge 16, the interconnection between the hinge member 16 and the flange 36 emanating from the base 12 is broken.

For example, the consumer may use both of their thumbs simultaneously to break away the hinge 16 in one squeeze or push. It can also be broken by a squeeze with one hand, such as between thumb and forefinger. FIG. 13 shows a side view of the hinge 16 breaking away from the flange 36 emanating outwardly and downwardly from the base by a squeeze type action. The "T" shape, as best seen in FIG. 9, helps reinforce this action and provides rigidity for the plastic material during the squeezing or pushing process. The reinforcing columns/ribs 44 and 46 on the hinge top and base flange 36, respectively, provides still further rigidity and prevents unwanted buckling.

Figure 18:
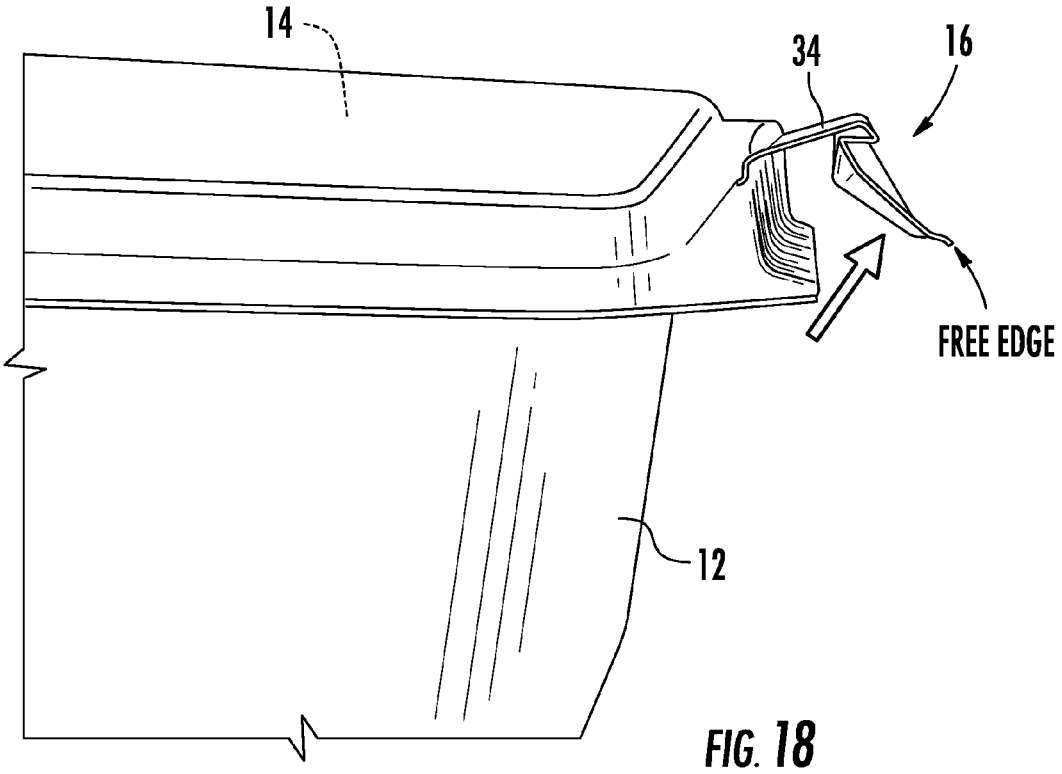
FIG. 18 is a side close-up view of the hinge of the container of FIG. 1 after it has been manipulated and in a breakaway condition.

After the hinge 16 breaks away, is springs upwardly, as can be seen in FIG. 18, where a free edge 38 is made available that can be easily seen by the consumer. This edge 38 facilitates separation of the lid 14 from the base 12.

Still referring to FIGS. 9 and 18, the hinge 16 is uniquely profiled so that it can be squeezed, pulled or pressed in different directions and the hinge 16 will break away. Also, the hinge profile is configured so that is springs upwardly as mentioned above. This popped open position of the hinge 16, as in FIG. 18, provides further clear evidence to a potential purchaser as to whether or not the container 10 has been tampered with. To assist in carrying out these functions, the hinge 16 includes a bend in its profile where the lid 14 and the base 12 are initially molded relative to one another so that the hinge 16 springs upwardly rather than resting in place, such as in the position seen in FIG. 9.

Figure 20:
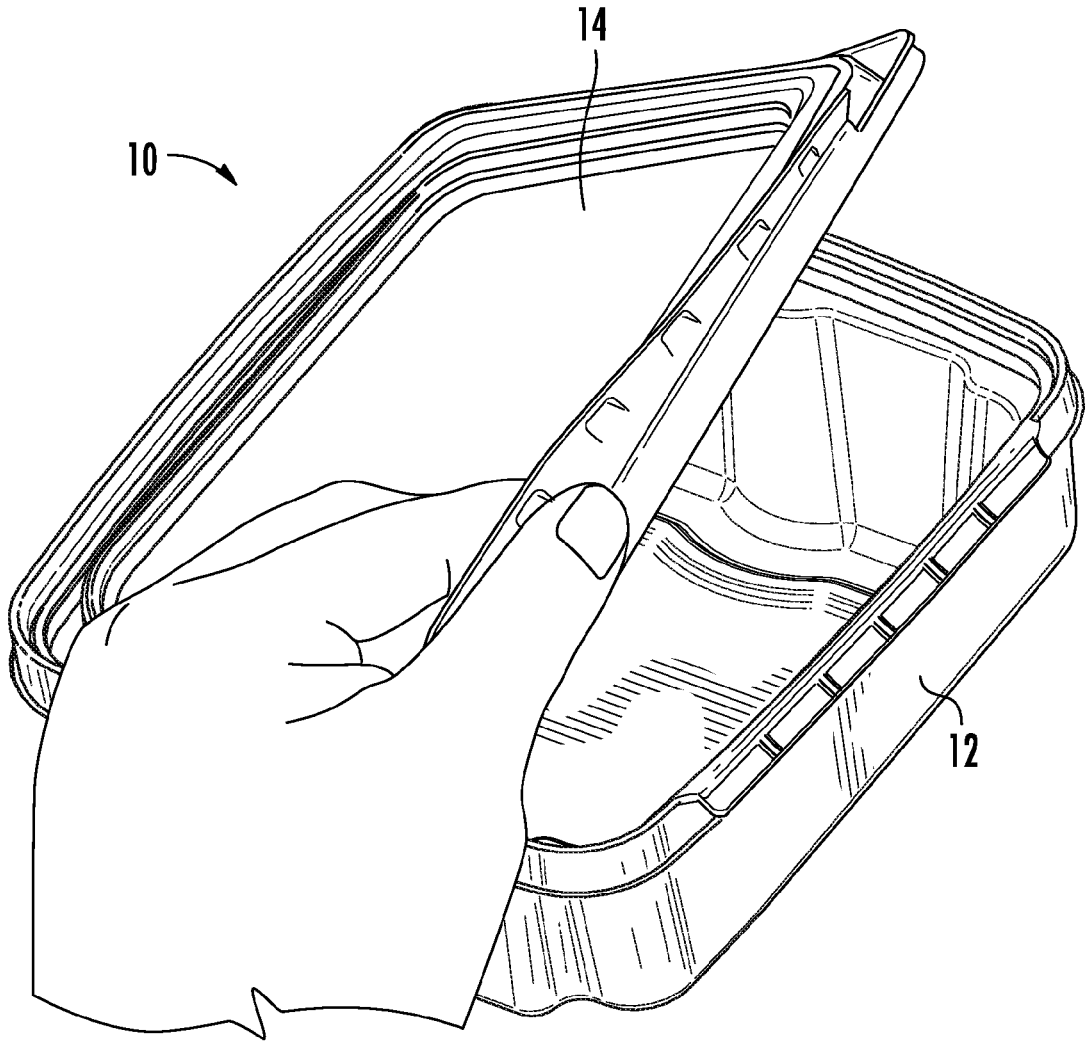
FIG. 20 is a perspective view of the lid being further pulled away from the base.

After breaking away, the hinge 16 clearly separates from the flange 36 on the base 12 to provide an edge 38 that the consumer can grasp, which is seen in FIG. 19. The flange 36 on the base 12 can also be grasped by the consumer's other hand whereby the lid 14 can be separated from the base 12, as in FIG. 20. The vertical reinforcing ribs 44 on the hinge 16 and the reinforcing ribs 46 on the base 12 make the "handles" more rigid to further facilitate the separation of the lid 14 from the base 12. It should be noted that the pulling method of breaking away, essentially carries out the breaking of the hinge 16 and lid 14 separates in one step.

Figure 21:
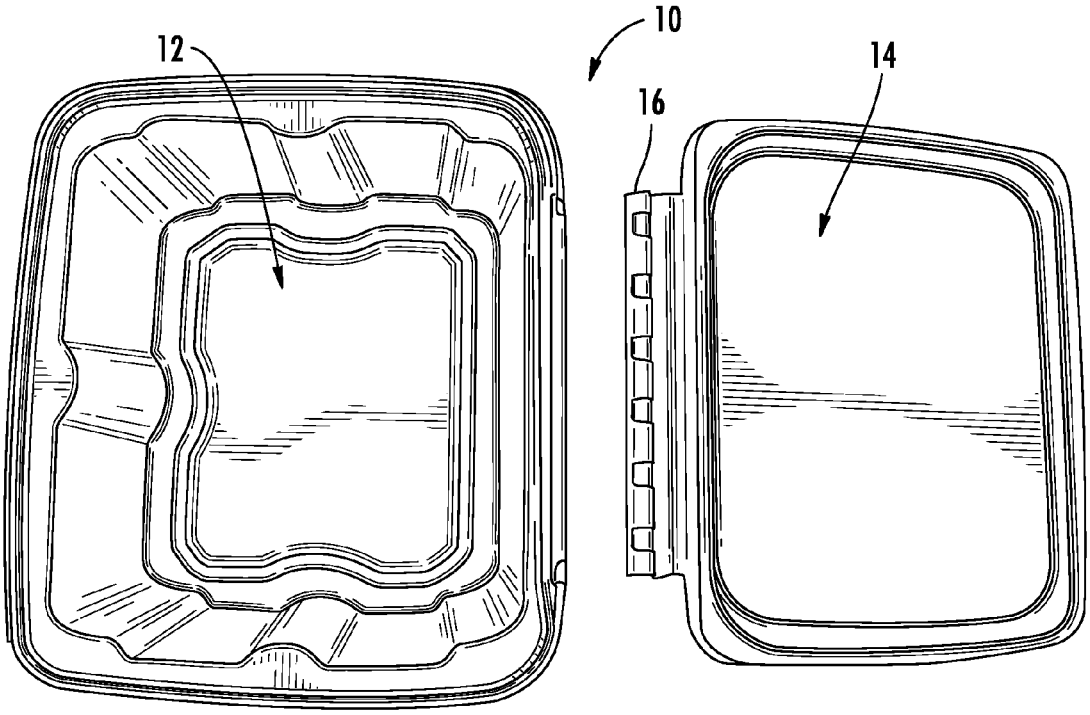
FIG. 21 is a plan view of the base and lid, with hinge remaining connected to the lid, after the hinge was manipulated to cause it to breakaway from the base.

In FIG. 21, the lid is shown completely separated from the base whereby the consumer can access the contents of the base, such as food. As can be seen, the hinge remains connected to the lid even after the lid is separated from the base.

Figure 22:
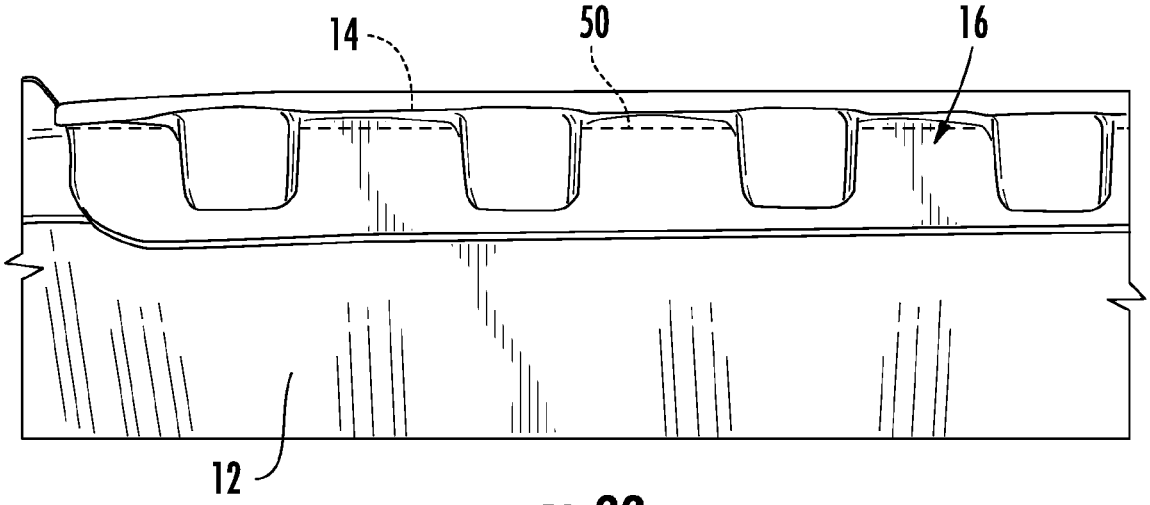
FIG. 22 is a close-up front view of the container of FIG. 1 with lid secured to the base and showing the ventilation air gap between the lid and the base.
Figure 23:
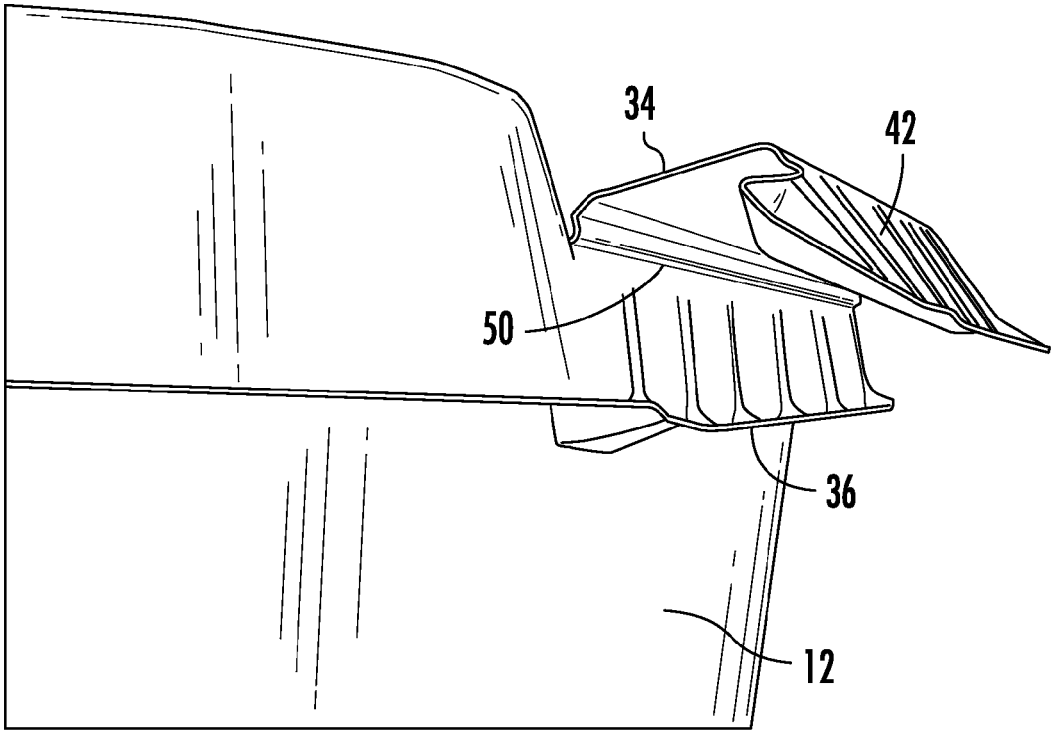
FIG. 23 is a close-up side view of the hinge forming a roof to prevent entry of liquids in the ventilation air gap seen in FIG. 22.

The important feature of the present invention is improved breathability and ventilation over prior art containers, as shown in FIGS. 22 and 23. In FIG. 22, it can be seen that the profile of the hinge 16 is configured to be preloaded so that when the lid 14 is installed into the base 12, the lid is literally pulling away from the base 12 in the region of the hinge 16. The remaining portion of the lid 14 that is secured and hidden in the bead or flange 22 of the base 12 provides a watertight seal. However, the base 12 is preferably devoid of a bead or flange 22 in the region of the hinge 16. This permits the preloading to cause a gap 50 to form between the lid 14 and base 12, as can be seen in FIG. 22. The preloading of the hinge 16 helps create tension toward the breakaway edge to assist in shearing.

At this point the nicks 40 are still bonding the hinge 16 in place. The preloading is not enough to break the bonding of the hinge 16 to the base 12. This slight gap 50 permits air to escape from the inside of the container 10, which is particularly useful for preventing mold growth and wilting of vegetables, for example if such items are the contents 18 of the container 10. It can be understood that the hinge 16, such as seen in FIG. 9, provides a protective "box-like" structure over the gap 50 to prevent liquid from spilling into the gap 50 from above. The ends of the hinge 16 are also fully open to permit release of air laterally from the container 10 for breathability and ventilation. Even when the hinge 16 is broken away and popped up, it still provides a "roof-like" structure, as in FIG. 23, to continue to prevent liquid from entering the gap 50 form above, which is now smaller because the preloading tension has been removed after the hinge 16 has been broken.

The container configuration 10 of the present invention is particularly well-suited for thermoformed containers that are made out of plastic, which may be transparent, translucent or opaque. The walls may be of, for example, 10 mil in thickness but may be of any desired thickness and flex so it could still permit the needed deflection of the hinge 16 so that a consumer can depress inwardly on the hinge to break the connection, as described in detail above. The profile of the hinge 16 may be modified so that it may spring in any desired direction to facilitate separation of the lid 14 from the base 12.

Thermoforming, using the appropriate tooling (not shown), is so well known in the art that it need not be discussed in detail herein. Suffice it to say that the tooling would be appropriately manufactured to provide the desired base 12, lid 14 and hinge 16 profiling. Containers 10 made out of other materials by other methods can also be achieved using the present invention.

In view of the foregoing, a new and novel container 10 with a breakaway hinge 16 is provided. The unique breakaway hinge 16 enables the consumer to manipulate the hinge 16 to break the lid 14 from the base 12. The, the freed hinge 16 itself and the base 12 are grasped by the consumer to separate the lid 14 from the base 12 to gain access to the contents 18 residing therein. The hinge 16 remains connected to the lid 14 to avoid the creation of small separate parts that must be disposed of separately.

It would be appreciated by those skilled in the art that various changes and modifications can be made to the illustrated embodiments without departing from the spirit of the present invention. All such modifications and changes are intended to be covered by the present invention and any appended claims.

What is claimed is:

1. A tamper-evident container, comprising:

a base having a bottom with at least one upstanding side wall with a top peripheral edge defining a top open end;

a lid, having a peripheral edge, hingedly connected to the base and configured to substantially enclose the top open end when attached to the top peripheral edge;

a hinge member hingedly connecting the lid to the base; the hinge member including a horizontal member and a vertical member; the vertical member being planar and rigid; the lowermost edge of the vertical member defining a bottom edge; the bottom edge of the vertical member, lying in a vertical plane, being releasably connected to the base at the top peripheral edge of the base; the horizontal member, lying in a horizontal plane includes an inner edge and an outer edge that are both substantially parallel with the peripheral edge of the lid, the inner edge being permanently connected to the peripheral edge of the lid; the horizontal member of the hinge being configured to extend laterally outwardly from the lid so that the vertical plane intersects the horizontal plane to provide a substantial T-shaped configuration that defines an open chamber bounded by the horizontal member, the vertical member and the base to releasably connect to the base proximal to the top peripheral edge thereof whereby the open chamber permits the hinge member to be manipulated to cause at least one of the horizontal member and the vertical member to deflect into the chamber and separate the vertical member away from the base.

2. The tamper-evident container of claim 1, further comprising:

a plurality of reinforcing members disposed laterally across the vertical member of the hinge.

3. The tamper-evident container of claim 1, wherein the vertical member is releasably connected to the base via a plurality of nicks at a connection point between the lowermost edge of the vertical member and the base.

4. The tamper-evident container of claim 1, wherein the base, lid and hinge are made of plastic.

5. The tamper-evident container of claim 1, wherein the top peripheral edge of the base includes an inwardly extending flange; the peripheral edge of the lid being configured to reside under the flange.

6. The tamper-evident container of claim 1, wherein the horizontal member of the hinge member includes at least one gripping tread.

7. The tamper-evident container of claim 1, wherein manipulation of the hinge member by squeezing the hinge member from above and below results in breaking the lowermost edge of the vertical member away from the base while retaining connection of the horizontal member of the hinge to the lid.

8. The tamper-evident container of claim 1, wherein manipulation of the hinge member by pulling up on the hinge member from below results in breaking the vertical member of the hinge away from the base while retaining connection of the horizontal member of the hinge to the lid.

9. The tamper-evident container of claim 1, wherein manipulation of the hinge member by pushing down on the hinge member from above results in breaking the vertical member of the hinge away from the base while retaining connection of the horizontal member of the hinge to the lid.

10. The tamper-evident container of claim 1, wherein manipulation of the hinge member by pushing laterally into the hinge member toward the lid results in breaking the vertical member of the hinge away from the base while retaining connection of the horizontal member of the hinge to the lid.

11. The tamper-evident container of claim 1, wherein the lowermost edge of the vertical member of the hinge being positioned a distance away from the peripheral edge of the base to indicate a tampered condition after the hinge has been manipulated and broken away from the base while retaining connection of the horizontal member of the hinge to the lid.

12. The tamper-evident container of claim 1, wherein a gap is defined between the lid and the top peripheral edge of the base when the bottom edge of the lid is connected to the peripheral edge of the base; the gap permitting air flow to items residing in a space defined by the base.

13. The tamper-evident container of claim 12, wherein the horizontal member and the vertical member of the hinge prevents liquids from entering the base via the gap.

* * * * *